United States Patent [19]

Breslow

[11] 4,036,493

[45] July 19, 1977

[54] GAME APPARATUS

[75] Inventor: Jeffrey D. Breslow, Highland Park, Ill.

[73] Assignee: Marvin Glass & Associates, Chicago, Ill.

[21] Appl. No.: 624,750

[22] Filed: Oct. 23, 1975

[51] Int. Cl.[2] ..... A63F 9/00

[52] U.S. Cl. ..... 273/1 M

[58] Field of Search ..... 273/1 R, 1 M, 1 E, 95 R, 273/95 H, 105 R, 102 R, 102.1 R, 102.1 C, 102.1 G

[56] References Cited

U.S. PATENT DOCUMENTS

| | | | |
|---|---|---|---|
| 1,254,767 | 1/1918 | Bolton | 273/102.1 R |
| 2,230,814 | 2/1941 | Roth | 273/102.1 G |
| 3,410,554 | 11/1968 | Harrison | 273/1 M |
| 3,795,400 | 3/1974 | Glass | 273/1 R |
| 3,817,528 | 6/1974 | Stuhler | 273/1 M |

*Primary Examiner*—William H. Grieb

*Attorney, Agent, or Firm*—Mason, Kolehmainen, Rathburn & Wyss

[57] ABSTRACT

A competitive game including a jar with separable upper and lower portions and weighted playing pieces for insertion thereinto. The two portions of the jar are held together against the force of gravity upon the lower portion by magnetic means therebetween. When the cumulative weight of the playing pieces inserted and lying within the lower portion of the jar exceeds the attractive magnetic force of the magnetic means, the lower portion will separate from the upper portion and thereby penalize the last player to insert a playing piece into the container.

5 Claims, 5 Drawing Figures

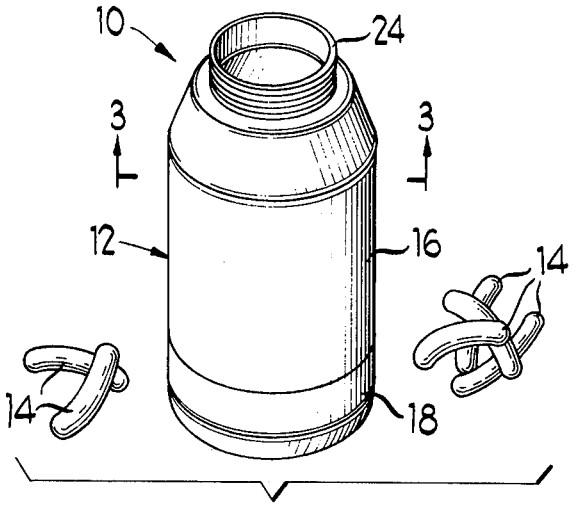
Fig 1
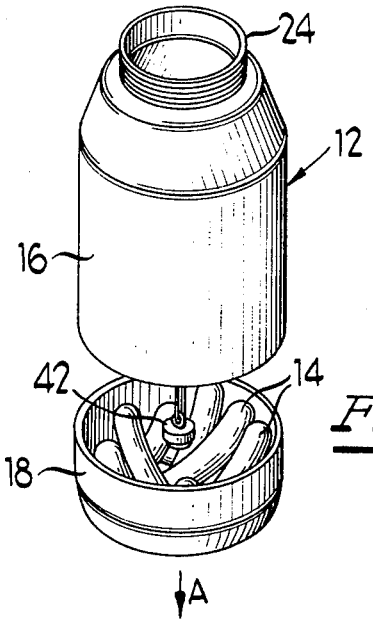
Fig 2
Fig 3
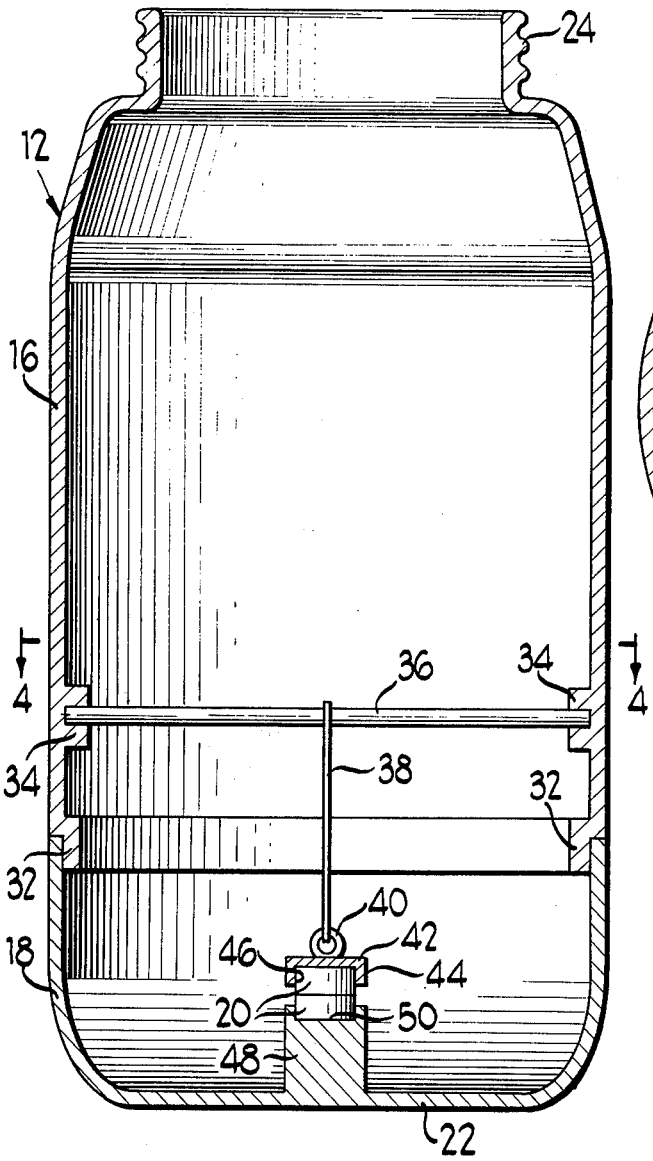
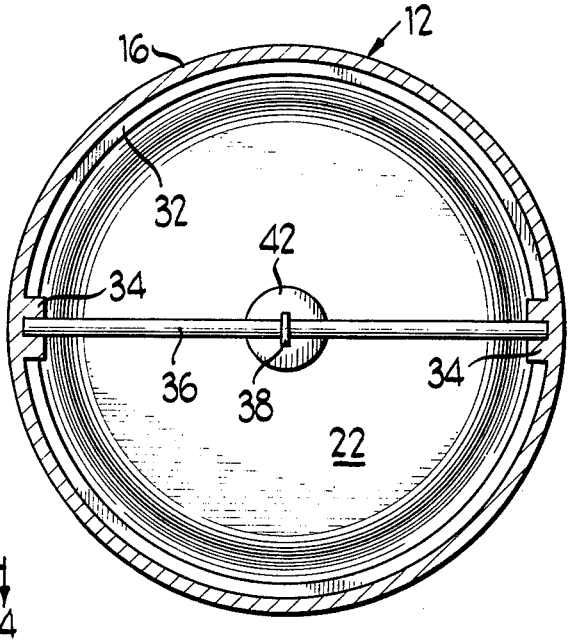
Fig 4
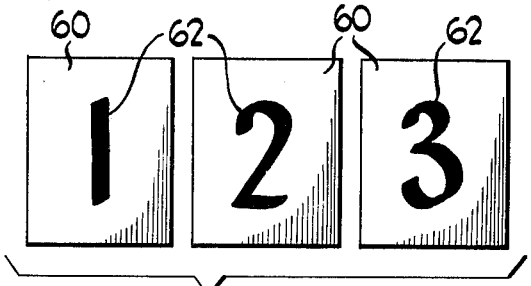
Fig 5

GAME APPARATUS

SUMMARY OF THE INVENTION

This invention relates to a competitive game including a container in the form of a simulated mustard jar and playing pieces in the form of simulated hotdogs. The container has a lower receiver portion which is downwardly displaceable relative to an upper portion of the container. The upper and lower portions of the container are held together by a pair of magnets. The simulated hotdogs are inserted individually into the container through a neck in the upper portion by the players of the game until the weight thereof is greater than the attractive force of the magnets, forcing the two container portions to separate. The player who deposited the last hotdog into the container at the time of the separation then must accept all of the hotdogs therewithin and proceed with the play of the game in an attempt to rid himself of all the hotdogs in his possession.

BRIEF DESCRIPTION OF THE DRAWINGS

FIG. 1 is a perspective view of the game of the present invention, showing the two portions of the jar in mating contact and a plurality of weights in the shape of simulated hotdogs alongside the container;

FIG. 2 shows the jar of FIG. 1 with the lower portion of the jar separated and falling away from the upper portion, with the weights lying therein;

FIG. 3 is a vertical, generally central sectional view, on an enlarged scale, of the container taken generally along line 3—3 of FIG. 1;

FIG. 4 is a horizontal sectional view taken generally along line 4—4 of FIG. 3; and FIG. 5 is a plan view of three playing cards used with the game apparatus.

DESCRIPTION OF THE PREFERRED EMBODIMENT

Referring to FIG. 1, the game of the present invention, generally designated 10, comprises a container, generally designated 12, simulating a mustard jar and a plurality of playing pieces 14 in the form of simulated hotdogs. The jar 12 comprises an upper portion 16 and a lower cup-shaped portion 18. The lower portion 18 is held in place to the upper portion 16 by a pair of mutually attracted permanent magnets 20, one each mounted to a respective jar portion and in abutting contact with each other in a magnetically attractive mode as opposed to a repelling mode. The hotdogs 14 are deposited, in turn, into the container 12 by a plurality of players seriatim during play of the game. When the weight of the hotdogs 14 laying in the lower portion 18 becomes greater than the magnetic attractive force of the magnets 20, the lower portion 18 will fall away from the upper portion 16 and the player who last deposited a hotdog into the container is penalized by having to accept all of the hotdogs within the container or jar at that time. The objective of the game is for a player to rid himself of all his hotdogs, thereby winning the game.

More specifically, the simulated mustard container 12 comprises a hollow generally cylindrical frame closed off by a bottom wall 22 of the lower container portion 18. The upper end of the container 12 tapers inwardly into a narrower open neck 24.

An inside peripheral flange 32 is disposed inwardly and extends downwardly from the lowermost portion of the upper jar portion 16, to form a male member of a complementary mating fit with the upper peripheral wall of the lower jar portion 18.

A pair of bosses 34 are diametrically disposed along the inner surface of the upper jar portion 16 and extend inwardly therefrom, with a shaft 36 extending therebetween and rigidly mounted thereto within appropriate concentrical holes therein. A vertical rod 38 depends from the center of shaft 36. The lower end of the rod 38 is circularly formed to captivate a ring 40. The ring 40 is appropriately attached to and centrally located upon a circular cap 42. The cap 42 comprises a central circular disc with a downward extending peripheral annular flange 44 forming a circular recess 46 therein.

One of the magnets 20 is fixed within the recess 46. When the upper jar portion 16 is mounted to the lower jar portion 18, the cap 42 and its respective magnet 20 extend within the lower jar portion 18.

A boss 48 extends concentrically upwardly from the inside surface of the bottom wall 22 of the lower jar portion and has a concentric circular recess 50 for fixedly receiving the lower magnet 20. When the upper jar portion 16 and the lower jar portion 18 forms a mating fit with the flange 32, and the upper magnet 20 within the cap 42 abuttingly contacts the lower magnet 20 within the boss 48 in an attracting polarity.

The attractive force between the magnets 20 provide the coupling force for maintaining the fitted relationship between the upper and lower jar portions.

When the quantity of simulated hotdogs 14 are tossed or placed into the neck 24 and rest upon the bottom wall 22, the cumulative weight of the hotdogs 14 will at some point be greater than the attractive force of the magnets 20 causing the lower portion 18 to separate from the upper portion 16 under the influence of gravity and fall away therefrom in the direction of arrow A as shown in FIG. 2. The size of the magnets used depends upon the weight that they are required to support.

FIG. 5 shows three of a plurality of playing cards 60 utilized with the game apparatus of the present invention. A set of such playing cards are provided with numerical indicating means 62 on one side thereof. These playing cards are shuffled and placed face down near the play area and the players, in turn, take a card and are required to place the number of playing pieces shown on the card into the container.

In addition, in the preferred embodiment of the invention, at least some of the playing pieces in the form of the simulated hotdog 14 are of different sizes and thus different weights than other of the playing pieces. This adds a considerable amount of intrigue to the game as well as calculation by the various players.

One scheme of playing the game of the present invention is that the container 12 is emptied to start the play of the game. Any means, such as chance devices (dice) can be used to determine which player is to first take his turn. The players initially are given a predetermined number of the hotdog playing pieces, preferably each player having the same number of different sizes of playing pieces. The first player then takes his turn and draws a card 60 from the set thereof and is required to deposit into the container the given number of playing pieces indicated by the card. In doing so, the container can be positioned on a table, or the like, and be lifted by that player after he has deposited his number of playing pieces. In the alternative, the players might be required to hold the upper container portion 16 as he deposits his playing pieces thereinto. With different sizes and thus weights of the playing pieces, various strategies would be involved during the play of the game. The first player to deposit a playing piece into the container which is sufficient to raise the accumulated weight of the playing pieces therein so as to cause the magnets to release and drop the lower container portion 18 as seen in FIG. 2. That player must then accept all of the playing pieces in the lower container portion to add to his own collection. The object of the game is for a player to be the first to rid himself of all of the playing pieces in his possession. Of course, other schemes of play are contemplated by the present invention.

The foregoing detailed description has been given for clearness of understanding only and no unnecessary limitations should be understood therefrom as some modifications will be obvious to those skilled in the art.

I claim:

1. A game apparatus, comprising, in combination:

a container having an upper portion and a separable generally cup-shaped lower portion combining to define an interior cavity of the container, with the lower container portion defining the bottom of the interior cavity, and a deposit opening in one of the said container portions in communication with the interior cavity;

a plurality of playing pieces depositable into the interior cavity of said container through said opening so as to come to rest on the separable lower portion of the container; and weight responsive release means in the form of attracting magnetic means between said upper and lower container portions to hold the same together but to release the separable lower portion from the upper portion in response to a sufficient number of playing pieces being deposited into the container, said attracting magnetic means including a permanent magnet fixed within the bottom of the cup-shaped lower container portion and an attractive permanent magnet fixed to means secured within the upper container portion and extending downwardly into the lower cotainer portion for positioning the permanent magnets in close proximity.

2. The game apparatus of claim 1 wherein at least some of said playing pieces are of different weights than other of said playing pieces.

3. The game apparatus of claim 1 wherein said container is generally upright with said deposit opening near the top thereof, and said playing pieces are elongated in shape.

4. A game apparatus comprising, in combination:

a container having an upper portion and a separable generally cup-shaped lower portion combining to define an interior cavity of the container, with the lower container portion defining the bottom of the interior cavity, and a deposit opening in one of said container portions in communication with the interior cavity;

a plurality of playing pieces depositable into the interior cavity of said container through said opening so as to come to rest on the separable lower portion of the container, at least some of said playing pieces being of different weights than other of said playing pieces; and weight responsive release means in the form of attracting magnetic means between said container portions to hold the same together but to release the separable lower portion from the upper portion in response to a sufficient number of said playing pieces being deposited into the container, said attracting magnetic means including a permanent magnet fixed within the bottom of the cup-shaped lower container portion and an attractive permanent magnet fixed within the upper container and extending downwardly into the lower container portion for positioning the permanent magnets in close proximity.

5. A game apparatus, comprising, in combination:

a container having an upper portion and a separable lower portion combining to define an interior cavity of the container, with the lower container portion defining the bottom of the interior cavity, and a deposit opening in one of said container portions in communication with the interior cavity, a plurality of playing pieces depositable into the interior cavity of said container through said opening so as to come to rest on the separable lower portion of the container, weight responsive release means between said container portions to hold the same together but to release the separable lower portion from the upper portion in response to a sufficient number of playing pieces being deposited into the container, said weight responsive release means being vertically disposed within the container and connected at an upper end to a cross piece within the upper container portion, the cross piece being disposed vertically between said deposit opening and the separable lower container portion, and inwardly protruding means formed on at least one of said upper and lower container portions on the inside of said interior cavity between said deposit opening and the bottom of said separable lower container portion and engageable with said playing pieces when deposited into the container.

* * * * *